United States Patent [19]

Sparling, II et al.

[11] Patent Number: 4,877,652

[45] Date of Patent: Oct. 31, 1989

[54] WASHABLE MASK PROCESS

[75] Inventors: Robert D. Sparling, II, Newmarket; Gerard L. Vachon, Somersworth, both of N.H.

[73] Assignee: Davidson Textron Inc., Dover, N.H.

[21] Appl. No.: 146,316

[22] Filed: Jan. 21, 1988

[51] Int. Cl.[4] ..... B05D 3/02; B05D 3/12; B05D 5/00; B05D 1/02

[52] U.S. Cl. ..... 427/264; 427/265

[58] Field of Search ..... 427/259, 264, 277, 270, 427/265, 266

[56] References Cited

U.S. PATENT DOCUMENTS 4,578,281 3/1986 Ebesawa et al. ..... 427/53.1

OTHER PUBLICATIONS

"Material Safety Data Sheet", (for Therm—Chek ® 5868), Bedford Chemical Division–Ferro Corporation, Jun. 1986.

"Material Safety Data Sheet", (for Stearic Acid F—1500 . . . F—300), Harwick Chemical Corporation, Jul. 1986.

"Material Safety Data Santicizer ® 160 Plasticizer," Monsauto Company, Jun. 1987.

"Material Safety Data Sheet" (for Pegosperse ® 200 ml), No. 12–570, Glyco, Inc., Nov. 1985.

"Materials Safety Data Sheet" (for VC–2605), Bordeu Chemical, Apr. 1986.

"Material Safety Data Sheet" (for VC–440), Bordeu Chemical, Apr. 1986.

"Material Safety Data Sheet" (for Plas—Chek ® 775), Bedford Chemical Division—Ferro Corporation, Mar. 1986.

*Primary Examiner*—Evan Lawrence

*Attorney, Agent, or Firm*—John C. Evans

[57] ABSTRACT

In a process for masking a part subjected to a high pressure washing cycle between the applications of two or more paint coats, the improvement comprising the steps of: spray coating on a prepainted part a washable masking material which is cuttable when set to form a nonwicking edge; self adhering the spray coating and cutting it along a paint line to form a nonwicking mask edge which prevents paint leakage or the trapping or washing solution between the masking material and part and leakage of such trapped washing solution onto a subsequently painted surface. The process includes the step of cutting and cleanly peeling a portion of the masking material from the part following the drying of the sprayed mask to expose part of the prepainted surface; at least one subsequent washing and drying of the masked part; and at least one subsequent painting of the exposed prepainted surface.

6 Claims, 2 Drawing Sheets

FIG 5
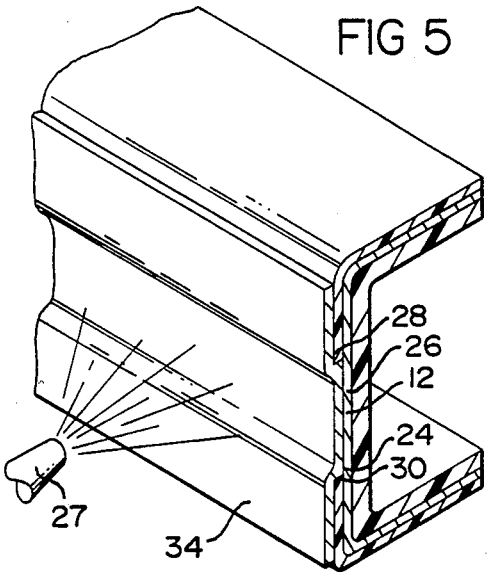
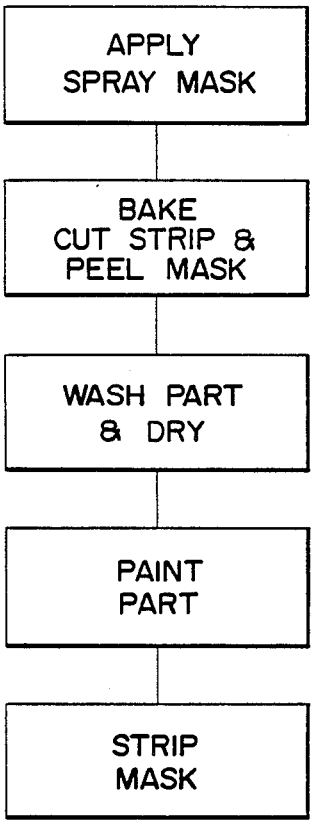
FIG 7
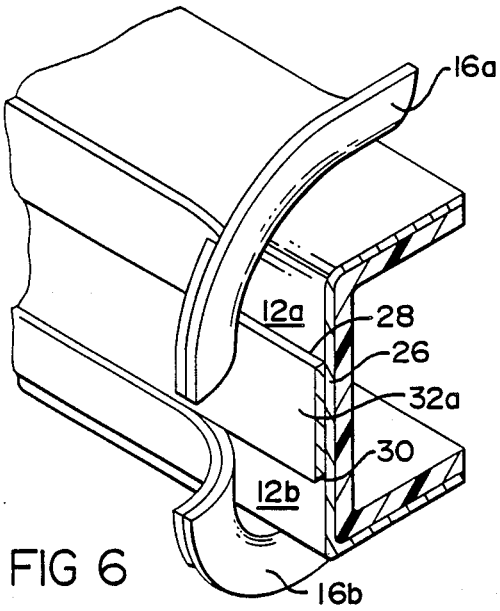
FIG 6

WASHABLE MASK PROCESS

BACKGROUND OF THE INVENTION

This invention relates to masking processes for painting parts and more particularly to masking processes which include washing and painting cycles of masked and unmasked portions of the processed part.

PRIOR ART

In the manufacture of two color parts such as fascia for automobile bumpers it is necessary to mask portions of the part between one or more painting cycles. Current masking processes for parts which are sequentially painted to form a multicolor part presently use paper, tape, spray mask or hard mask systems which are applied prior to a paint/bake cycle. The mask is removed from the part following the application of a second paint coat.

Such masking processes include the step of cutting a coat or cover of masking material to form a well defined paint line against which a second paint coat is applied to produce a resultant precision paint line between the sequentially applied paint coats. While such an approach, in theory, can be used to make two color parts, a problem arises when the part is processed in a high volume manufacturing system. Under such conditions the part can pick up dust or other foreign material which can affect the quality of the second paint coating.

Accordingly, prior to painting it is desirable to direct the part through a wash station to remove any foreign particles from the unmasked surfaces thereon prior to subsequent painting and baking cycles. None of the aforementioned masking systems however have been successfully utilized in conjunction with such washing steps, primarily because of mask edge wicking problems.

One such problem arises when washing solution migrates across an exposed edge of the mask line to be trapped under the mask. Trapped liquid subsequently leaks from under the mask line onto the paint surface during a paint bake cycle. Such leakage can reduce the gloss or finish of the final product. Paint material may also wick across the mask line and run onto the first paint layer. Another problem is that the mask line may be mechanically disturbed by the washing process.

An alternative process eliminates the edge wicking problem. A part is first washed and then painted and baked. The wash step removes foreign particles from the part before it is primed. The primed part is then subjected to a follow up wash and top coat process n which a base color and clear coat are applied to the part. The painted part is completely masked to protect the painted surface. A black rub strip is then connected to the masked part and it is baked in a non-washing facility. The masking material is removed from the part resulting in a two color part (black strip and underlying color coating on the part): The rub strip material has a dull gloss which hides dust which thereon prior to final unmasking step. Thus the high gloss top coat of the final part can be protected until the part is unmasked at final assembly.

The present invention solves the edge wicking problem by providing a masking process in which a wash step is provided between masking and a subsequent paint step without disturbing the paint line or without wicking of paint across the mask edge to a masked surface. The process also includes a self-adhering masking to prevent trapping of washing solvent and leakage of such trapped washing solvent onto a subsequent paint surface during a subsequent paint bake cycle.

SUMMARY OF THE INVENTION

The process of the instant invention improves masking processes including washing and paint or cover coat sequences by the steps of: applying a first color coating to the surface of the part in preparation for masking, trimming and subsequent painting; spray coating and drying masking material on the first color coating of a composition to be cleanly peeled from such first coating; cutting such masking material to define a paint line and peeling a portion of the masking material from the part to form a nonwicking edge; washing and drying the masked and exposed part by subjecting the part to high pressure cleaning solution; applying a second paint coating on the washed surfaces of the part; and thereafter peeling the remainder of the spray coated masking material from the part to define a precise break line between first and second colored surfaces on the part.

More specifically the masking process includes the step of depositing the coated masking material on the first painted surface at a film thickness in the range of 2–6 mils.

Another feature of the masking process is the step of maintaining nonwicking edge adhesion of the cut masking material while subjecting the coated masking material to plural paint bake cycles of 40 minutes at 285 ° F. so as to prevent paint wicking or the trapping of washing solution under the masking material and consequent leakage thereof onto the exposed part surfaces during one of the paint bake cycles.

Other features of the masking process of the present invention are to self-adhere coated masking material to a painted surface following drying thereof to withstand at least a two minute washing cycle at a temperature of 160° F. and to cleanly peel the masking material from the part following a final paint bake cycle thereby to define a precise paint line between first and second color paint coatings.

Still another feature of the masking process of the present invention is to provide a straight line or other desired mask line form with a nonwicking edge by mixing the masking material to have minimum solids of 30%–40% by volume and having a set film build-up which is cuttable by a sharp edge tool to define a smooth sharp cut line.

BRIEF DESCRIPTION OF THE DRAWINGS

Other advantages of the present invention will be readily appreciated as they become better understood with reference to the following detailed description when considered in conjunction with the accompanying drawings wherein:

FIG. 5 is a perspective view like FIG. 4 showing a second paint coating applied to the masked part;

FIG. 6 is a fragmentary perspective view of the painted part having the mask material removed therefrom; and FIG. 7 is a chart showing the process of the present invention.

Referring now to FIG. 1, a part 10 is illustrated suitable for being processed by the present invention to have two color coatings thereon separated by a precision paint line.

Figure 1:
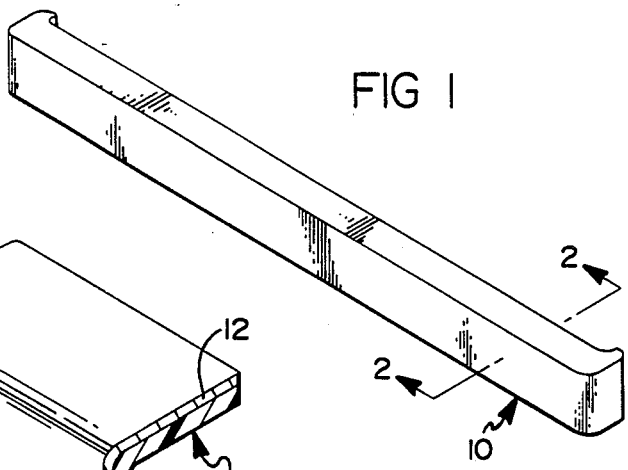
FIG. 1 is a perspective view of a part processed by the present invention.
Figure 2:
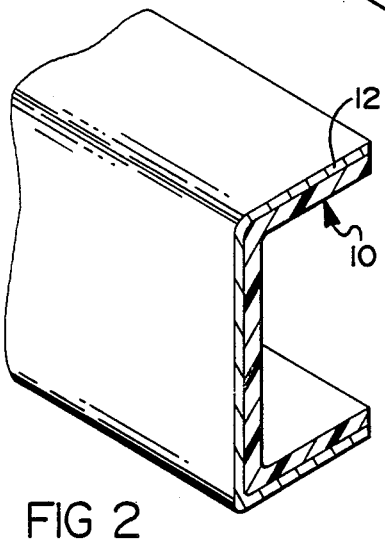
FIG. 2 is an enlarged cross sectional view taken along the line 2—2 of FIG. 1 looking in the direction of the arrows.

More particularly, the part 10 is a fascia for a bumper. Initially, the part 10 is formed by a RIM process of the type set forth in U.S. Pat. No. 4,379,100 issued Apr. 5, 1983. The molded article which is formed by such processes is passed through a wash station and an air blast drying station and dried. Thereafter, the part is cooled and a paint coat 12 is applied to the fascia 10 and baked thereon. The part is then cooled and removed from the line. The prime or paint coated fascia 10 is shown in FIG. 1 with the prime coat 12 shown covering the external surfaces of the fascia.

The part is then cooled and removed from the prime coat line and, in accordance with the present invention, has a suitable masking material applied thereto by spray deposition from a nozzle 14.

In accordance with the present invention, the material is a sprayable water base coating which has a minimum viscosity in the range of 60–75 Krepps Units (KU). A plastisol form of the invention can be coated by rolling. A sprayable mask composition may include a minimum solid content of 30%–40% by volume. In the case of some plastisol coatings, the material can have a solids percentage approaching 99% by volume.

The preferred color of the sprayable masking material is grey or white to provide an observable contrast with colored paint or prime surfaces on the fascia 10.

The mask coating is deposited at a film thickness of from 2 to 6 mils either by spraying or by rolling. The coat is set by drying or curing to form a mask coating which will remain in place on the part when the part is hung on a conveyor system which will dispose certain surfaces of the part in a vertical plane.

Sprayable masking material is preferably sprayed through a spray gun 14 such as a DeVilbiss MBC spray gun at an atomization pressure set not to exceed 90 psi. The composition and viscosity of the material is such that it will freely pump at 90° F using standard paint pumps. In the case of airless spray equipment, the gun pressure can range from 2100 psi for water base material to 4300 psi for plastisols.

The water base coating is set by being dried to form a film thickness of from 2 to 6 mils which is tack free after being dried in a 190° F. oven for a time period of 12 minutes. A plastisol film build up is set by holding it at a temperature and time required to cure the material.

Figure 3:
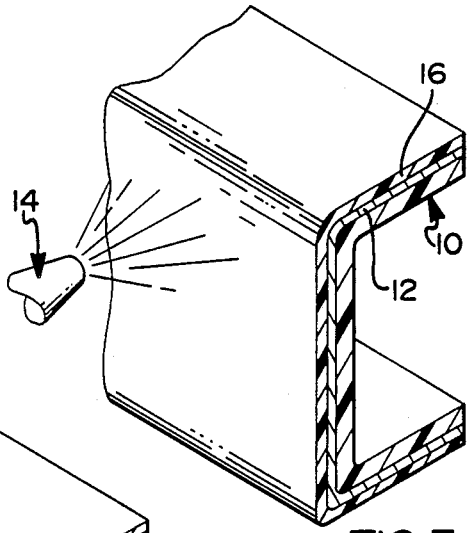
FIG. 3 is a fragmentary perspective view of a part which is masked.

The resultant mask coating is shown at 16 in FIG. 3.

In accordance with the present invention, the coating is cut along paint lines 18, 20 and is peeled from the fascia 10 to expose a strip 22 of paint coat 12 between the paint lines 18, 20 for receiving a second coating of a paint color which will contrast with either an underlying prime coat or first paint color.

An example of a suitable washable spray mask material has the following formulation:

| Component | PPH |
|---|---|
| VC 440 - PVC dispersion resin (polyvinyl chloride homopolymer) - Borden Chemical Co. | 60 |
| VC 260S - PVC blending resin (polyvinyl chloride homopolymer) - Borden Chemical Co. | 40 |
| BBP Santicizer ® 160 - plasticizer (butyl benzyl phthalate) - Monsanto Co. | 70 |
| ESO Plas-Chek ® 775 - plasticizer (epoxidized soybean oil) - Ferro Corporation | 3 |
| ESO/SA 33.3% (Harwick F - 300) - lubricant (stearic acid) - Harwick Chemical Corp. | 1.4 |
| Pegosperse ® 200 ML - viscosity depressant (polyethylene glycol 200 monolaurate) - Glyco Corp. | .75 |
| Therm-Chek ® 5868 - heat stabilizer (alkaline earth and barium and cadmium salts) - Ferro Corp. | 3 |

The process is set forth in the chart of FIG. 7 as including application of a prime or other first color coating to the substrate or fascia 10.

Thereafter, the part is subject to a coating of a washable spray mask of the aforesaid composition and the mask coating 16 is baked and cut to form precise paint lines 18, 20.

The coating 16 is then peeled off to expose a strip 22 of the first coating.

The peeling action also forms a precise nonwicking edge surface 24 and a like edge surface 26 that bounds either side of the strip 22 so as to define a precise surface against which a second paint coating can be directed by a paint nozzle 27 as shown in FIG. 5.

Figure 4:
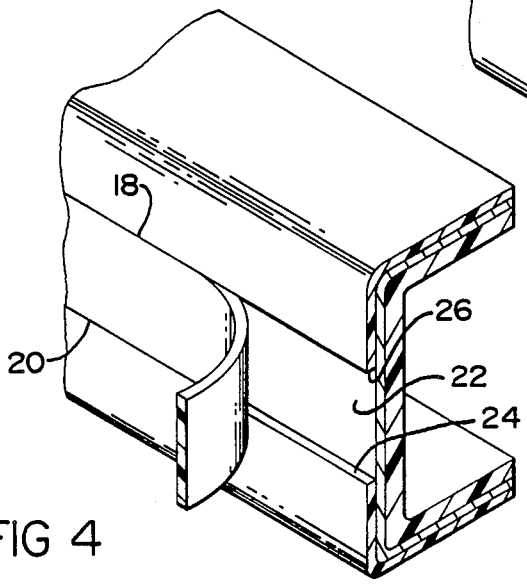
FIG. 4 is a fragmentary perspective view of a paint line and nonwicking edge of a mask formed on the part in accordance with the present invention.

In accordance with certain principles of the present invention, the aforedescribed water base mask coating retains its form when subjected to a washing cycle. In many manufacturing processes, the surface of strip 22 collects dust or other foreign materials in a high volume manufacturing environment. Thus, in accordance with the invention, the part is directed through a wash station and blow dried and cooled prior to having the second paint coat directed thereagainst from the nozzle 27. The composition of the washable spray mask material is such that the nonwicking edge surface 24 will not be mechanically displaced from a desired paint line position with respect to the first paint coat 12 as shown in FIG. 4. Furthermore, the composition is such that the washable spray mask coating 16 will remain firmly adhered along a contact line 28 and a contact line 30 formed, respectively, at the intersections of the nonwicking surfaces 24, 26 and paint coat 12. The nonwicking surfaces 24, 26 and the adhesion of the mask coating 16 thereby prevent the second paint coat from weeping across the coating 12. Also, the washing solution which is directed thereagainst to remove dust particles from the panel 22 is not trapped underneath the mask coating. This avoids subsequent leakage of the solution onto a second paint coating.

Once the second colored coating 34 is applied to the part, it is baked at temperature in the range of 250°–270° F. for a time period of 30 to 35 minutes and cooled.

The part or fascia 10 is then removed from the line and the remainder of the mask coating 16 is peeled at sections 16*a* and 16*b* thereof from the part to form colored panels 12*a*, 12*b* on either side of a paint coat segment 32*a* which remains once the masking portions 16*a* and 16*b* are removed from the part. The coating composition has been found to withstand spray wash cycles wherein the water wash or cleaning solution is at a temperature of 160° F. and is applied for a wash period of two minutes. A suitable washing compound is ISW-32, sold by Dubois Chemical Company. Furthermore, the composition of the washable spray coating 16 firmly adheres in place as forced air drying is applied thereagainst after both wash and rinse cycles.

A typical washing cycle includes exposing parts to a phosphoric acid wash having a pH range of from 3.5 to 5.5 at 120°–150° F. and a water pressure of 20–30 psi. A deionized water rinse can be applied to the part prior to drying the part with subsequent paint coatings being applied thereafter. The washing time and temperature will depend upon the kinds of wash steps required for a particular part and the kinds of foreign matter which might build up on the strip 22. For example, one series of washes might be used for dust and another for dust and oil film deposits. The mask of the present invention maintains a nonwicking edge which will hold its shape during a wide range of such washes.

All paint bake conditions are produced by passing the part through convection type ovens.

Suitable primer or paint coatings are thermosetting enamels which include a variety of solvents such as hydrocarbons, alcohols or acetates.

The resulting fascia has two colors separated by a precise paint line.

The mask composition is such that, while it provide sufficient adhesion to prevent separation or mechanical distortion of the paint lines 18, 20, it nevertheless is cleanly peelable from the part without leaving residual material on the part after the masking material is removed therefrom.

The material composition of the washable mask coating 16 furthermore will not affect the color or gloss appearance of the underlying coating 12. The composition has substantial body to prevent bleed through of a second layer of paint, and it has sufficient solids to allow the mask to be peeled from the part as separate integral pieces 16*a*, 16*b*.

The washable mask process has only two coats of paint applied.

Consequently, one advantage of the improved process for masking a material with a peelable masking material is that less paint is used to form a contrasting two tone part. This reduces emissions and, furthermore, will require less energy because there are fewer bake cycles.

A further feature is that less handling is required and this, in turn, produces an increase throughput capacity.

The process of the present invention has been described in an illustrative manner, it is to be understood that the terminology which has been used is intended to be in the nature of words of description rather than of limitation.

Obviously, many modification and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

What is claimed is:

1. In a masking process for selectively painting a surface of a part with first and second color paint to form a precise paint line between the two colors of paint, the improvement comprising:

applying a first color paint coating to the surface of the part in preparation for masking, mask trimming and subsequent painting;

masking the surface of the part with a layer of settable and adherent washable masking material so as to cover the first color paint coating, said material being cuttable when set to form a non-wicking edge;

setting the washable masking material on the first color paint coating to form an adherent layer of masking which covers the first color paint coating so as to be retained thereon during washing and which can be readily and cleanly removed from the first color paint coating following washing;

cutting a first predetermined portion of the set washable masking material to define a paint line and peeling the first predetermined portion of the set washable masking material from the first color paint coating to form an exposed surface thereon while retaining a second predetermined portion of the set washable masking material on the first color paint coating, the second predetermined portion having a non-wicking edge corresponding to the paint line;

washing and drying the masked and exposed portions of the part surface and thereafter applying a second colored paint coating on the washed surfaces of the part at the non-wicking edge; and thereafter cleanly peeling the second predetermined portion of the set washable masking material from the part surface to define a precision paint line between the first and second color paint coatings on the part.

2. In the masking process of claim 1, coating the settable and adherent washable masking material by applying a film thickness thereof on said first color paint coating in the range of 2 to 6 mils;

setting the masking material by baking the film thickness at a cure temperature for a cure time period required to cure the material and to adhere the masking material to the first color paint coating to prevent edge separation thereof during washing so as to avoid weeping of material across the cut paint line defined by the non-wicking edge.

3. In the masking process of claim 1, washing the retained second predetermined portion of the washable masking material and the exposed first color paint coating by directing a washing solution thereagainst at a temperature in the range of 110 and 170 degrees F. and for a time duration to remove foreign matter from the exposed first color paint coating.

4. The masking process of claim 1 further including mixing the settable masking material to form a sprayable material having minimum solids of 30%–40% by volume;

applying and the settable washable masking material by spray coating and;

spraying the settable masking material to cover the first color paint coating with a preset thickness of film having a uniform consistency which is cuttable by a sharp edge tool to define a resultant smooth sharp non-wicking edge forming a sharp paint line.

5. In the masking process of claim 3, setting the settable and adherent washable masking material by baking the film thickness at a cure temperature for a cure time period required to cure the material and to adhere the masking material to the first color paint coating to prevent edge separation thereof during washing so as to avoid weeping of material across the cut paint line defined by the non-wicking edge.

6. In the masking process of claim 4, applying the settable and adherent washable masking material by applying a film thickness thereof on the first color paint coating in the range of 2 to 6 mils;

setting the settable and adherent masking material by baking the film thickness at a cure temperature for a cure time period required to cure the material and to adhere the masking material to the first color paint coating to prevent edge separation thereof during washing so as to avoid weeping of material across the cut paint line defined by the non-wicking edge.

* * * * *